United States Patent [19]

Hayes et al.

[11] 3,967,367

[45] July 6, 1976

[54] METHOD FOR ALIGNING LOUDSPEAKER DIAPHRAGM AND VOICE COIL ASSEMBLY

[75] Inventors: William L. Hayes; Jerry A. Siciliano, both of Anaheim, Calif.

[73] Assignee: Altec Corporation, Anaheim, Calif.

[22] Filed: Oct. 14, 1975

[21] Appl. No.: 621,963

[52] U.S. Cl. ..... 29/594; 29/464; 29/606; 179/115.5 VC

[51] Int. Cl.[2] ..... H04R 31/00

[58] Field of Search ..... 29/594, 464, 271, 606; 179/115.5 VC, 115.5 PC, 115.5 R

[56] References Cited

UNITED STATES PATENTS

| | | | |
|---|---|---|---|
| 3,755,889 | 9/1973 | Busian | 29/271 X |
| 3,792,526 | 2/1974 | Bremseth | 29/594 |

*Primary Examiner*—Carl E. Hall
*Attorney, Agent, or Firm*—Edward A. Sokolski

[57] ABSTRACT

A technique for accurately aligning the voice coil of a high frequency driver type loudspeaker in an annular magnetic gap formed between the top plate and the pole piece-phasing plug assembly thereof. A pair of dowels are attached to the top plate by means of screws, at positions separated from each other. The inside diameter of the dowels is greater than the diameter of the screws so as to permit radial adjustment of the position of the dowels on the screws. The screws are first left loose so that the dowels have limited freedom of radial movement. A jig member having a plurality of radial finger portions arranged in a circle is placed over the pole piece-phasing plug assembly with the ends of the finger portions lying in the magnetic gap against the side of the phasing plug. The voice coil diaphragm assembly is then placed over the jig member with the voice coil in the magnetic gap formed between the top plate and the pole piece-phasing plug, and with locating aperture portions of the assembly fitted over the dowels, the jig fingers having a thickness such as to provide proper centering of the coil. The dowels are freed to move radially on their associated screws to permit the positioning of the assembly in its centered location. In this location, the screws are tightened to lock the dowels in position. The jig member is then removed and the diaphragm voice coil assembly fixedly attached to the top plate with the apertures therein fitted over the dowels, so as to center the voice coil in the gap.

4 Claims, 10 Drawing Figures

METHOD FOR ALIGNING LOUDSPEAKER DIAPHRAGM AND VOICE COIL ASSEMBLY

This invention relates to a method for assembling driver loudspeakers, and more particularly to such a method utilizing a jig member in conjunction with alignment dowels, which facilitates the centering of the speaker voice coil in the annular magnetic gap between the top plate and the pole piece-phasing plug.

Driver loudspeakers, which generally operate in conjunction with horn radiators for transducing high frequency sound, often utilize a centrally located dome topped cylindrical pole piece-phasing plug which is surrounded by a magnetic top plate. An annular magnetic gap is formed between the top plate and the pole piece-phasing plug in which the voice coil is positioned. Serious distortion in the output and eventual failure of the voice coil will result if the voice coil is installed in contact with either the top plate or the pole piece-phasing plug. Even if the voice coil does not contact either of these members, it is highly desirable to center the coil in the gap for optimum response.

It has been somewhat of a problem in the production of such driver loudspeaker units to provide rapid and reliable centering of the voice coil in the magnetic gap. One possible solution is to hold the parameters of the components, including the locations of the various apertures for the attachment of fixed dowel pins or screws, to very close tolerances. This, however, greatly increases the cost of production. Therefore, with techniques of the prior art, alignment has generally been achieved in a fixed dowel pin or rim centering, or in some cases a "cut and try" fashion, i.e., an initial effort has been made to properly align the voice coils, visually, and the units later tested for objectionable distortion which might require realignment. This approach has been somewhat time consuming and generally results in a certain number of units having some distortion being passed into the field. Further, there is no way of assuring that an optimum centering of the voice coil has been achieved. Further, in replacing diaphragm and voice coil assemblies in the field, the same "cut and try" procedure has been required. This is particularly undesirable where replacement is accomplished by relatively inexperienced personnel without test equipment or even a good subjective criterion for evaluating the output of the loudspeaker.

The technique of the present invention overcomes the aforementioned difficulties by providing a simple, highly effective technique for accurately aligning the voice coil in the magnetic gap without stress on the mechanical assembly due to mechanical inaccuracies. The technique of the invention can be accomplished by relatively inexperienced personnel, either at the factory or in the field, and obviates purely visual evaluation of the centering. By assuring proper centering every time, the need for evaluation of the speaker output as regards such centering is generally obviated, greatly facilitating the assembly of the loudspeaker.

It is therefore an object of this invention to facilitate the centering of voice coils in driver type loudspeakers.

It is a further object of this invention to obviate distortion difficulties in driver type loudspeakers due to improper installation of the speaker diaphragm and voice coil assembly.

It is still a further object of this invention to lessen the time required for installing a diaphragm and voice coil assembly in a driver type loudspeaker and at the same time improve accuracy of alignment.

Other objects of this invention will become apparent as the description proceeds in connection with the accompanying drawings, of which:

Figure 1:
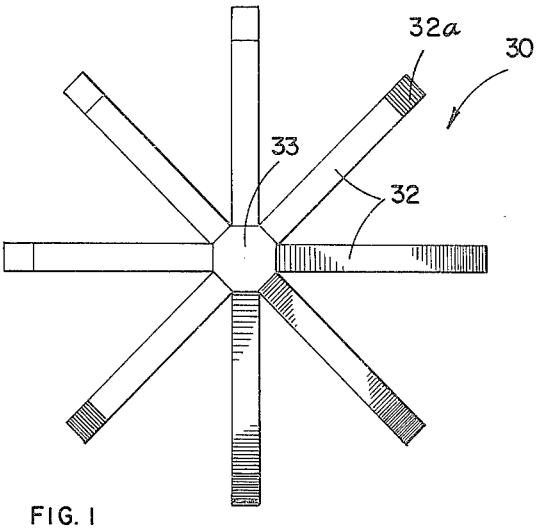
FIG. 1 is a top plan view of a jig member which may be utilized in practicing the preferred embodiment of the invention.

Briefly described, the method of the invention is as follows: A spacer jig member is placed with at least portions thereof in the annular magnetic gap between the pole piece-phasing plug and top plate of a driver loudspeaker, the spacer member portions providing a predetermined spacing for the voice coil from the pole piece-phasing plug. A pair of dowel members are loosely mounted on the top plate for radial motion relative thereto by means of screws, the diameter of the threaded portion of these screws being less than the inner diameter of the dowels. A diaphragm and voice coil assembly is placed in position on the pole piece-phasing plug and top plate with the voice coil portion thereof in the magnetic gap and spaced from the pole piece-phasing plug by the spacer jig member. The assembly has apertures formed in the mounting ring thereof which fit over the dowels in snug relationship, the dowels moving radially as necessary to enable the positioning of the voice coil in the gap over the jig member. The screws are then tightened to fix the dowels in position, these dowel positions establishing the aligned position for the voice coil centered in the magnetic gap. The assembly is then taken off the pole piece-phasing plug and top plate, and the jig member removed. Finally, the assembly is reinstalled in position with the aforementioned apertures seated on the dowels and the assembly fastened to the top plate in this position by means of mounting screws.

Referring now to FIGS. 3–6, a driver loudspeaker of the type contemplated for assembly by the technique of this invention is illustrated. Circular top plate 11 has a central aperture formed therein and is fixedly attached to housing 12. Mounted in the center of the housing in the aperture formed in top plate 11 is a combined pole piece-phasing plug 14. The pole piece-phasing plug and top plate are assembled such that an annular magnetic gap 15 is formed therebetween. Diaphragm and voice coil assembly 17 has a mounting ring 18 for use in mounting the assembly on top plate 11. Supported on mounting ring 18 is a diaphragm 19 which fits over the pole piece-phasing plug and to which an annular voice coil assembly 20 is attached, the voice coil being installed in magnetic gap 15. The positioning of voice coil assembly 20 in the gap is governed by the radial positioning of dowel members 22 on screws 23, there being a pair of such dowel members positioned on opposite sides of plate 11 which fit snugly within apertures 18*a* formed in mounting ring 18 (see FIG. 8).

Figure 5:
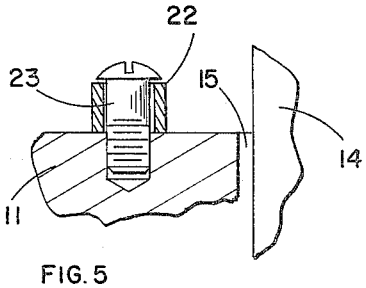
FIG. 5 is a cross sectional view taken along the plane indicated by 5—5 in FIG. 3.
Figure 6:
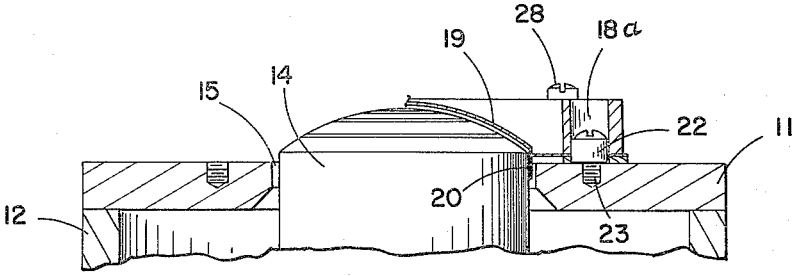
FIG. 6 is a cross sectional view further illustrating the assembly of FIG. 3.

As shown in FIG. 5, the diameter of the threaded portion of screw 23 is less than the inside diameter of dowel 22 to permit radial movement of the dowel members when the screw is not tightened down thereagainst. Diaphragm and voice coil assembly 17 is fastened to top plate 11 by means of screws 28 which fit through apertures formed in mounting ring 18 and threadably engage the plate 11. It is to be noted that access is provided to the heads of screws 23 through apertures 18*a* to permit the tightening thereof once dowels 22 have been set in their alignment positions.

Figure 2:
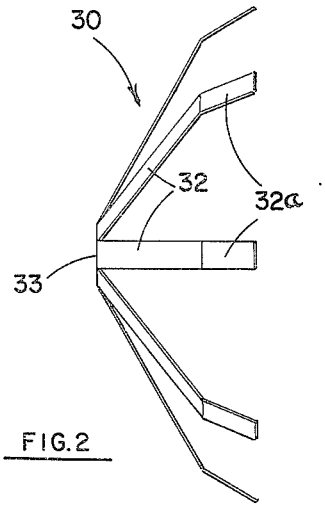
FIG. 2 is a side view of the jig member illustrated in FIG. 1.
Figure 4:
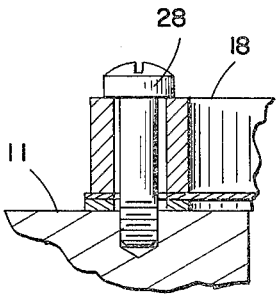
FIG. 4 is a cross sectional view taken along the plane indicated by 4—4 in FIG. 3.
Figure 3:
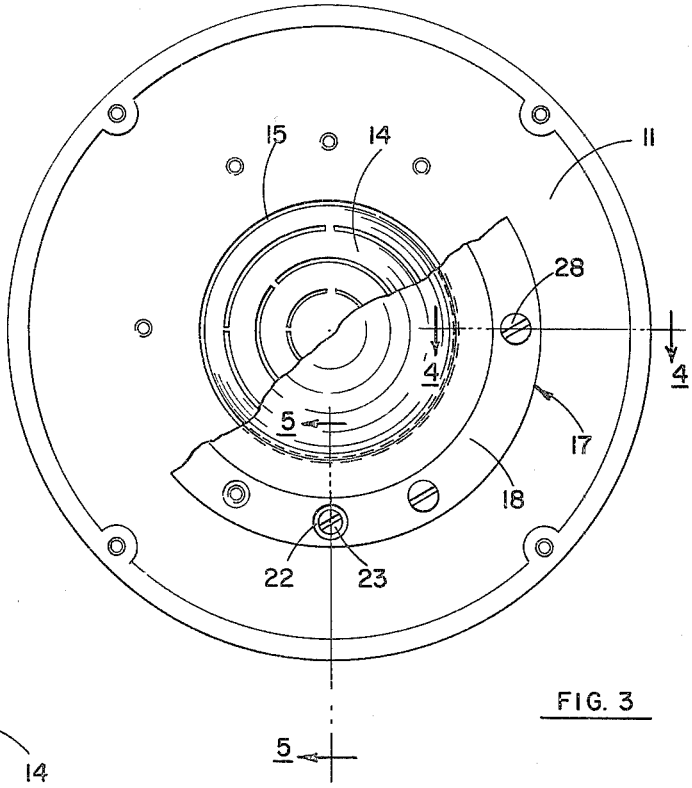
FIG. 3 is a top plan view with partial cutaway section illustrating a diaphragm and voice coil assembly which has been installed by the technique of the invention.

Referring now to FIGS. 1 and 2, a preferred jig member which may be utilized in carrying out the technique of the invention is illustrated. This jig member 30 may be fabricated of a plastic, metal or other material having a predetermined thickness as may be necessary to provide the desired spacing for the voice coil from the pole piece-phasing plug. The device has a plurality of fingers 32 which extend out radially from a central portion 33. The end portions 32*a* of the fingers are bent inwardly such that they will conveniently fit into gap 15 along the sides of the phasing plug, as indicated in FIG. 7, these end portions being bent over at positions along the fingers which coincide wth the edge of the phasing plug when the jig member is installed thereover.

Figure 7:
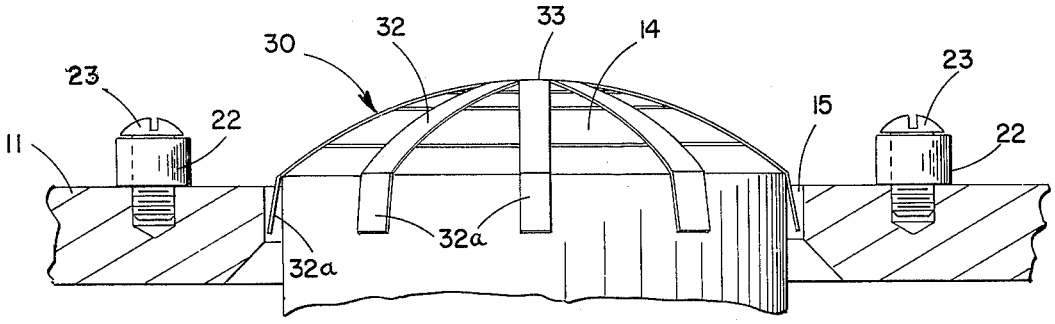
FIGS. 7–10 are a series of cross sectional views illustrating the successive steps in carrying out the preferred embodiment of the method of the invention.

Referring now to FIGS. 7–10, the sequential steps in installing the diaphragm and voice coil assembly by use of the technique of the invention are illustrated. As shown in FIG. 7, the jig member 30 is first installed in position over pole piece-phasing plug 14 with the bent over end portions 32*a* placed in the magnetic gap 15. A pair of oppositely positioned dowel members 22 are loosely installed (i.e., with freedom of radial motion) by means of screws 23, the inner diameters of the dowels being greater than the diameters of the threaded portions of screws 23.

Figure 8:
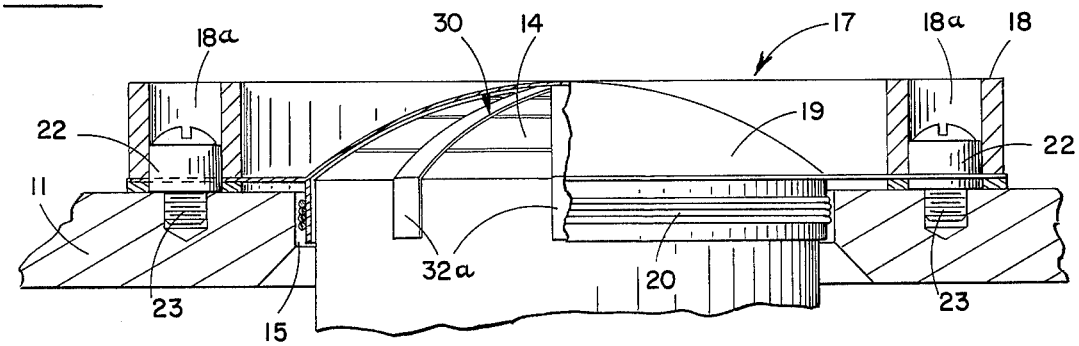

As shown in FIG. 8, diaphragm and voice coil assembly 17 is then placed in position wth diaphragm 19 placed over pole piece-phasing plug 14, voice coil 20 inserted in gap 15 and apertures 18*a* of mounting ring 18 placed over dowels 22. Dowels 22, as already noted, are free to move radially and thus will so move as may be necessary to permit the installation of voice coil 20 in the gap in a centered position as determined by jig member 30. Screws 23 are then tightened down to retain the dowels firmly in position. As already noted, dowels 22 fit snugly within apertures 18*a* so that once they are tightened in position, they provide a precise alignment for assembly 17 relative to pole piece-phasing plug 14 and top plate 11, thereby also determining the position of the voice coil within the magnetic gap.

Figure 9:
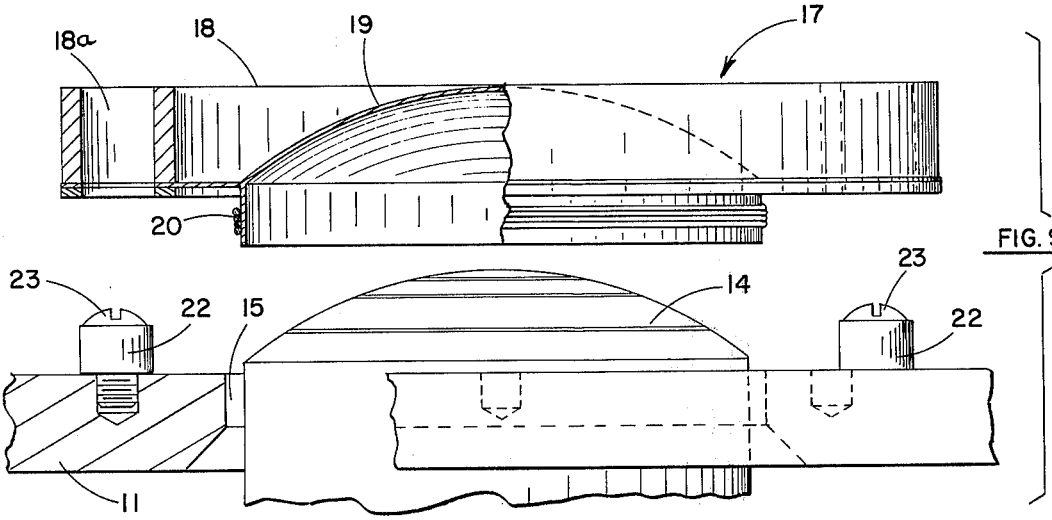
Figure 10:
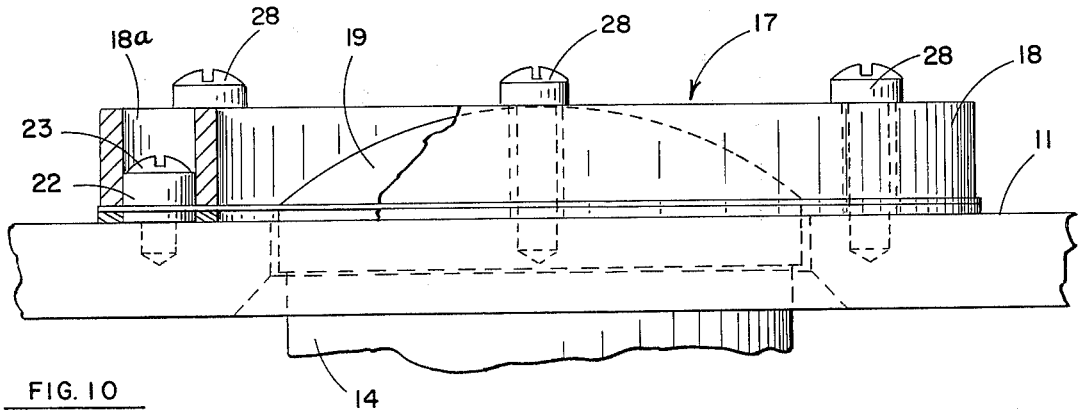

Diaphragm and voice coil assembly 17 is then removed from top plate 11 and phasing plug 14 as indicated in FIG. 9, and jig 30 removed. Finally, as shown in FIG. 10, the diaphragm and voice coil assembly is installed in position with the voice coil properly positioned in the gap by virtue of the alignment afforded by dowels 22, screws 28 being tightened down to retain mounting ring 18 on plate 11.

It is to be noted that while the jig member shown in FIGS. 1 and 2 has been found to be ideally suited for use in carrying out the technique of the invention, that other spacer means such as, for example, an annular strip placed in the gap could also be utilized.

The technique of this invention thus provides a simple yet highly effective means for accurately installing a diaphragm and voice coil assembly in a driver type loudspeaker.

While the invention has been described and illustrated in detail, it is to be clearly understood that this is intended by way of illustration and example only and is not to be taken by way of limitation, the spirit and scope of the invention being limited only by the terms of the following claims.

We claim:

1. A method for accurately installing a diaphragm and voice coil assembly in a driver type loudspeaker with the voice coil of the assembly centered in an annular magnetic gap between a pole piece-phasing plug and a top plate of the speaker, comprising the steps of:

placing spacer means in said gap, said spacer means having a thickness dimension equivalent to the desired spacing between the coil and the pole piece-phasing plug, loosely installing at least a pair of dowel members on retaining means attached to the top plate, said dowel members being free to move radially relative to the top plate, placing the diaphragm and voice coil assembly over the phasing plug and on the top plate with the voice coil in the magnetic gap and with the spacer means acting to center the coil in the gap, said assembly having a mounting ring with apertures formed therein into which the dowel members are fitted snugly, said dowel members assuming a position on the top plate due to the centering of the voice coil in the gap, with the diaphragm and voice coil assembly installed in position, locking the dowel members, in their assumed position, to the top plate by means of their associated retaining means, and fastening said assembly to the top plate.

2. The method of claim 1 wherein said spacer means comprises a jig member having fingers extending radially from a central portion, the jig member being placed over the pole piece-phasing plug with the end portions of said fingers placed in said gap adjacent to the sides of the plug so as to space the voice coil from the plug.

3. The method of claim 1 wherein the retaining means comprises a screw on which each dowel member is mounted, the inside diameter of the dowel members being greater than the diameters of the threaded portions of their associated screws.

4. The method of claim 1 and further including the step of removing the spacer means from the assembly after the dowel members have been locked to the top plate and before the assembly is fastened to the plate.

* * * * *